US007915971B2

(12) United States Patent
Arakawa et al.

(10) Patent No.: US 7,915,971 B2
(45) Date of Patent: Mar. 29, 2011

(54) NONRECIPROCAL CIRCUIT DEVICE

(75) Inventors: Shigeji Arakawa, Kanazawa (JP); Yukihiro Kitaichi, Ishikawa-gun (JP); Takashi Kadooka, Hakusan (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 84 days.

(21) Appl. No.: 12/424,691

(22) Filed: Apr. 16, 2009

(65) Prior Publication Data

US 2009/0273410 A1 Nov. 5, 2009

(30) Foreign Application Priority Data

May 1, 2008 (JP) ..... 2008-119693

(51) Int. Cl.
*H01P 1/32* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | | |
|---|---|---|---|---|
| 6,559,732 | B2 * | 5/2003 | Makino et al. | 333/1.1 |
| 2002/0033742 | A1 | 3/2002 | Makino et al. | |
| 2007/0063784 | A1 * | 3/2007 | Kawanami | 333/24.2 |
| 2007/0236304 | A1 | 10/2007 | Kawanami | |

FOREIGN PATENT DOCUMENTS

| | | | |
|---|---|---|---|
| JP | 2002-198707 | A | 7/2002 |
| JP | 2002-217611 | A | 8/2002 |
| JP | 2004-328476 | A | 11/2004 |
| JP | 2006-238286 | A | 9/2006 |
| JP | 2008-092147 | A | 4/2008 |
| JP | 2008-119693 | A | 5/2008 |
| WO | 2006/093039 | A1 | 9/2006 |
| WO | 2007/046229 | A1 | 4/2007 |

OTHER PUBLICATIONS

Official Communication issued in corresponding Japanese Patent Application No. 2008-119693, mailed on Apr. 13, 2010.

* cited by examiner

*Primary Examiner* — Stephen E Jones
(74) *Attorney, Agent, or Firm* — Keating & Bennett, LLP

(57) ABSTRACT

A nonreciprocal circuit device includes a ferrite-magnet element having ferrite provided with first and second central electrodes intersecting each other in an insulated manner and two permanent magnets arranged to sandwich the ferrite to apply a DC magnetic field thereto, a substrate on which the ferrite-magnet element and matching circuit elements are mounted, and a flat plate yoke. A first resin layer made of a cured liquid resin is provided at bonding portions of the ferrite-magnet element to the substrate, and a second resin layer made of a cured soft sheet-shaped resin adhered to a rear surface of the flat plate yoke is provided around the ferrite-magnet element and the matching circuit elements.

4 Claims, 10 Drawing Sheets

NONRECIPROCAL CIRCUIT DEVICE

BACKGROUND OF THE INVENTION

1. Field of the Invention

The present invention relates to a nonreciprocal circuit device, and particularly, to a nonreciprocal circuit device, such as an isolator or a circulator, used in a microwave band, and also to a manufacturing method of the nonreciprocal circuit device.

2. Description of the Related Art

Nonreciprocal circuit devices, such as an isolator and a circulator, have characteristics to transmit signals only in a specific direction but not in the direction opposite thereto. By using these characteristics, for example, isolators are used in transmission circuit portions of mobile communication apparatuses, such as an automobile phone and a mobile phone.

In International Publication WO 2007/046229, a nonreciprocal circuit device is disclosed in which a first central electrode and a second central electrode are wound around a substantially rectangular parallelepiped ferrite in an electrically insulated manner so as to intersect each other, a pair of permanent magnets is disposed on two primary surfaces of the ferrite to define a ferrite-magnet assembly so as to apply a direct current magnetic field to the ferrite, and side portions of the ferrite-magnet assembly mounted on a circuit board are surrounded by a yoke.

However, in the nonreciprocal circuit device disclosed in International Publication WO 2007/046229, although the periphery of the ferrite-magnet assembly is surrounded by the yoke, since a cavity is provided around the periphery, the device described above is unfavorably influenced by humidity. In addition, since the side portions of the ferrite-magnetic assembly are surrounded by the yoke, the number of components is increased, and a manufacturing process is complicated.

SUMMARY OF THE INVENTION

To overcome the problems described above, preferred embodiments of the present invention provide a nonreciprocal circuit device which eliminates the adverse influence of humidity and which can be efficiently manufactured and, a manufacturing method for the nonreciprocal circuit device.

According to a preferred embodiment of the present invention, a nonreciprocal circuit device includes a ferrite-magnet element which includes ferrite having two primary surfaces on which central electrodes are arranged to intersect each other in an electrically insulated manner and a pair of permanent magnets arranged on the two primary surfaces of the ferrite so as to apply a direct current magnetic field to the ferrite, a substrate having a surface to which the ferrite-magnet element is bonded so that the two primary surfaces of the ferrite are perpendicular or substantially perpendicular to the surface of the substrate, a flat plate yoke arranged to cover a top surface of the ferrite-magnet element, a first resin layer which is disposed at least at a bonding portion of the ferrite-magnet element bonded to the substrate and which is a cured liquid resin, and a second resin layer which is adhered to a rear surface of the flat plate yoke and which is a cured soft sheet-shaped resin.

According to another preferred embodiment of the present invention, a manufacturing method for a nonreciprocal circuit device includes the steps of bonding a ferrite-magnet element, which includes ferrite having two primary surfaces on which central electrodes are arranged to intersect each other in an electrically insulated manner and a pair of permanent magnets arranged on the two primary surfaces of the ferrite so as to apply a direct current magnetic field to the ferrite, to a surface of a substrate so that the two primary surfaces of the ferrite are arranged perpendicular or substantially perpendicular to the surface of the substrate, disposing a liquid resin at a bonding portion of the ferrite-magnet element bonded to the substrate, followed by curing to form a first resin layer, and disposing a flat plate yoke provided with a soft sheet-shaped resin adhered to a rear surface thereof on a top surface of the ferrite-magnet element, and after the soft sheet-shaped resin is softened, curing the soft sheet-shaped resin to form a second resin layer.

According to preferred embodiments of the present invention, since the periphery of the ferrite-magnet element is sealed with the first and second resin layers, the influence of humidity is eliminated. Since the permanent magnets are provided on the respective primary surfaces of the ferrite which is provided with the central electrodes, a yoke surrounding the side portions of the ferrite is not always required. In addition, the first and second resin layers can be easily formed, respectively, by automatically applying a liquid resin and by pressing and softening a sheet-shaped resin adhered to the flat plate yoke. Furthermore, when the substrates and the flat plate yokes are manufactured in the form of a mother substrate, manufacturing can be efficiently performed using a multiple-elements forming method.

Other features, elements, steps, processes, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, preferred embodiments of a nonreciprocal circuit device and a manufacturing method thereof according to the present invention will be described with reference to the accompanying drawings.

First Preferred Embodiment

Figure 1:
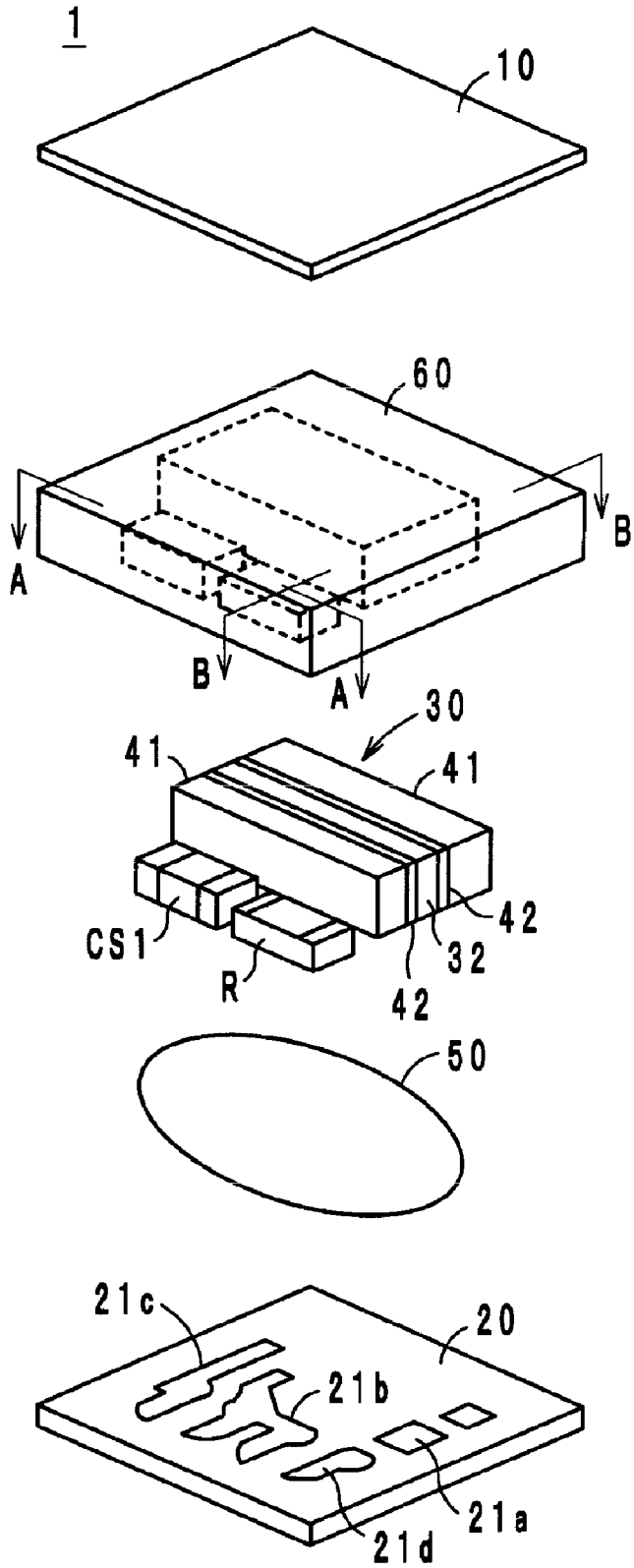
FIG. 1 is an exploded perspective view showing a nonreciprocal circuit device (e.g., two-port isolator) according to a first preferred embodiment of the present invention.

FIG. 1 is an exploded perspective view showing a two-port isolator 1 according to the first preferred embodiment of a nonreciprocal circuit device of the present invention. This two-port isolator 1 preferably is a lumped constant isolator and includes a flat plate yoke 10, a substrate 20, a ferrite-magnet element 30 composed of ferrite 32 and a pair of permanent magnets 41, a first resin layer 50, and a second resin layer 60.

Figure 2:
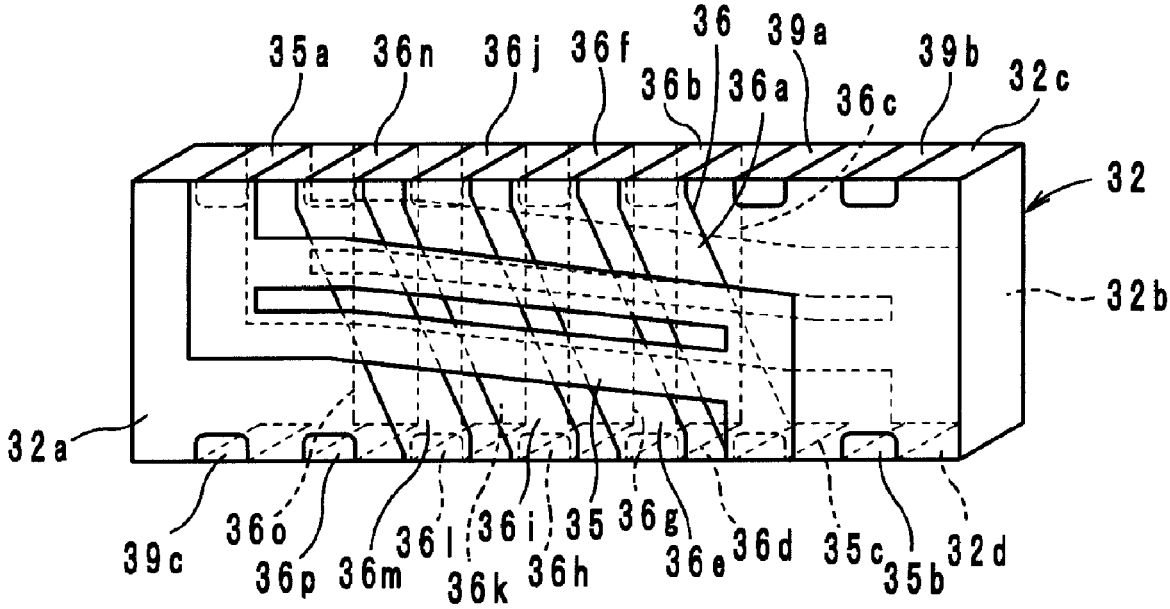
FIG. 2 is a perspective view showing a ferrite provided with central electrodes.

As shown in FIG. 2, a first central electrode 35 and a second central electrode 36, which are electrically insulated from each other, are arranged on a front first primary surface 32*a* and a rear second primary surface 32*b* of the ferrite 32. In this preferred embodiment, the ferrite 32 is a substantially rectangular parallelepiped having the first primary surface 32*a* and the second primary surface 32*b*, which are parallel or substantially parallel to each other.

Figure 4:
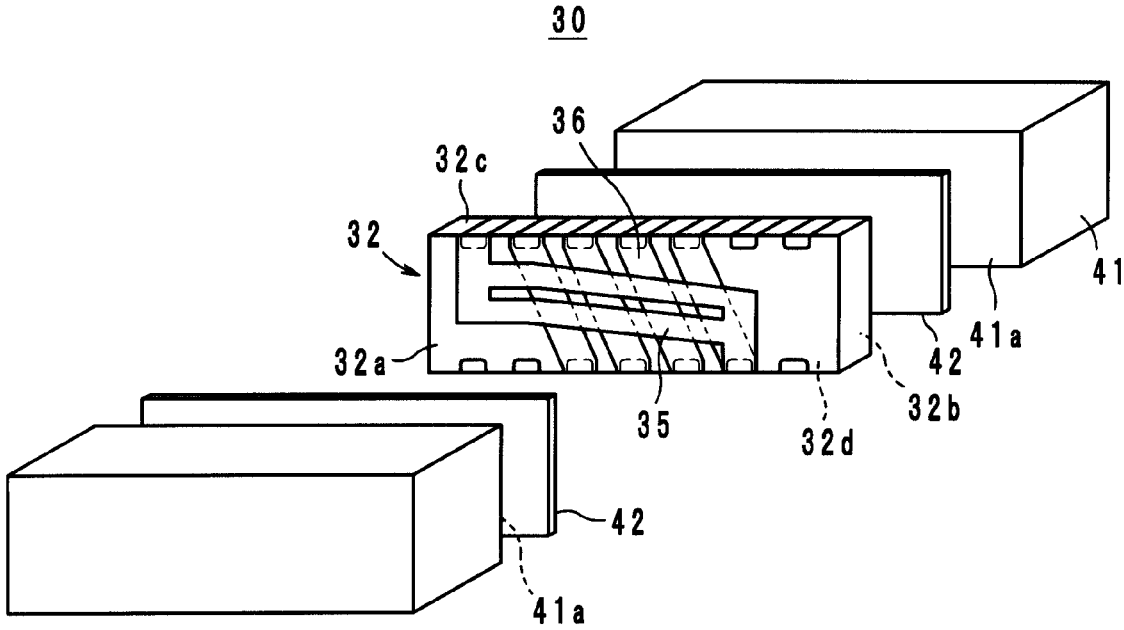
FIG. 4 is an exploded perspective view showing a ferrite-magnet element.

In addition, the permanent magnets 41 are adhered to the primary surfaces 32*a* and 32*b* of the ferrite 32 with epoxy adhesives 42 provided therebetween so as to apply a direct current magnetic field to the primary surfaces 32*a* and 32*b* in a direction perpendicular or substantially perpendicular thereto (see FIG. 4), so that the ferrite-magnet component 30 is provided. Primary surfaces 41*a* of the permanent magnets 41 each have the same or substantially the same dimension as that of each of the primarily surfaces 32*a* and 32*b* of the ferrite 32 and are arranged to face the respective primary surfaces 32*a* and 32*b* so that their peripheries coincide or substantially coincide with each other.

The first central electrode 35 is made of a conductive film. That is, as shown in FIG. 2, the first central electrode 35 is arranged from a right bottom side of the first primary surface 32*a* of the ferrite 32, is extended while being divided into two portions to a left top side at a relatively low inclined angle with respect to a long side of the first primary surface 32*a*, is then extended to the second primary surface 32*b* through an interconnection electrode 35*a* provided on a top surface 32*c*, and is arranged on the second primary surface 32*b* while being divided into two portions so as to be overlapped with the central electrode 35 on the first primary surface 32*a* through the ferrite 32, and one end of the first central electrode 35 is then connected to a connection electrode 35*b* provided on a bottom surface 32*d*. In addition, the other end of the first central electrode 35 is connected to a connection electrode 35*c* provided on the bottom surface 32*d*. As described above, the first central electrode 35 is wound one turn around the ferrite 32. In addition, the first central electrode 35 and the second central electrode 36 which will be described below intersect each other so as to be insulated from each other with an insulating film provided therebetween. The intersection angle between the central electrodes 35 and 36 is determined in accordance with requirements, so that input impedance and insertion loss are adjusted.

The second central electrode 36 is preferably made of a conductive film. The second central electrode 36 includes a first half turn portion 36*a* arranged obliquely on the first primary surface 32*a* from the right bottom side to the left top side at a relatively large angle with respect to the long side of the first primary surface 32*a* so as to intersect the first central electrode 35 and is extended to the second primary surface 32*b* through an interconnection electrode 36*b* provided on the top surface 32*c*, and a first turn portion 36*c* extended from the first half turn portion 36*a* is provided on the second primary surface 32*b* so as to perpendicularly or substantially perpendicularly intersect the first central electrode 35. A lower end portion of the first turn portion 36*c* is extended to the first primary surface 32*a* through an interconnection electrode 36*d* provided on the bottom surface 32*d*, and a first-and-half turn portion 36*e* extended from the first turn portion 36*c* is provided on the first primary surface 32*a* parallel or substantially parallel to the first half turn portion 36*a* so as to intersect the first central electrode 35 and is extended to the second primary surface 32*b* through an interconnection electrode 36*f* provided on the top surface 32*c*. Subsequently, in the same manner as described above, a second turn portion 36*g*, an interconnection electrode 36*h*, a second-and-half turn portion 36*i*, an interconnection electrode 36*j*, a third turn portion 36*k*, an interconnection electrode 36*l*, a third-and-half turn portion 36*m*, an interconnection electrode 36*n*, and a fourth turn portion 36*o* are provided on the surfaces of the ferrite 32. In addition, the two ends of the second central electrode 36 are connected to the connection electrode 35*c* and a connection electrode 36*p* provided on the bottom surface 32*d* of the ferrite 32. As described above, the connection electrode 35*c* is used as the connection electrodes at the end portions of the first and the second central electrodes 35 and 36.

Figure 3:
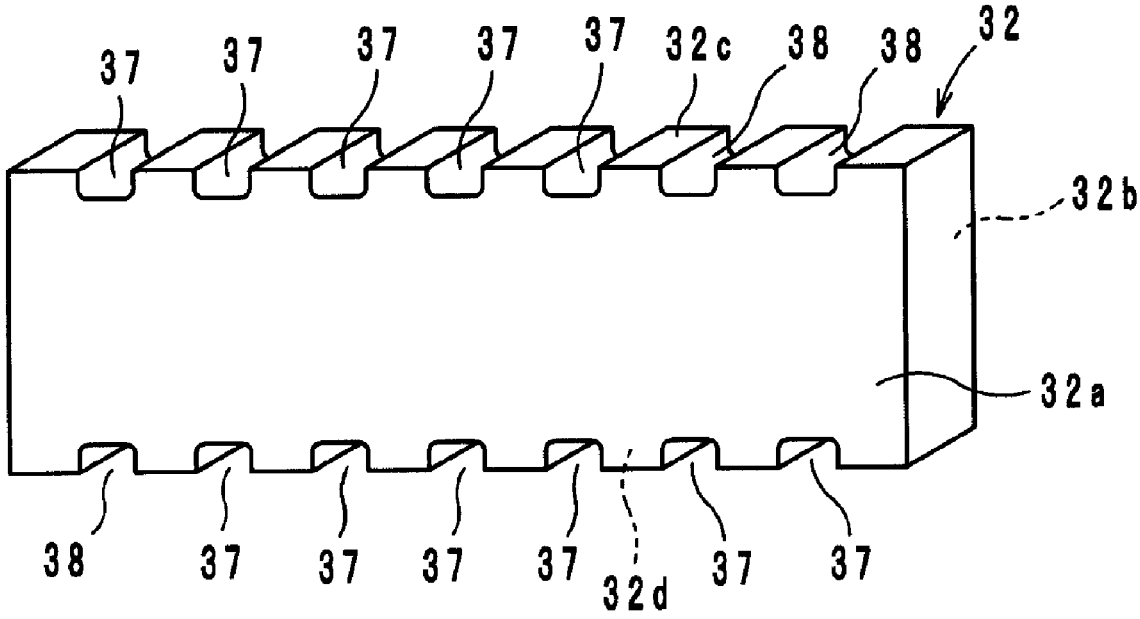
FIG. 3 is a perspective view showing a base body of the ferrite.

In addition, the connection electrodes 35*b*, 35*c*, and 36*p* and the interconnection electrodes 35*a*, 36*b*, 36*d*, 36*f*, 36*h*, 36*j*, 36*l*, and 36*n* are formed by applying or filling an electrode conductor, such as silver, a silver alloy, copper, or a copper alloy, in concave portions 37 (see FIG. 3) provided in the top and the bottom surfaces 32*c* and 32*d* of the ferrite 32. Furthermore, dummy concave portions 38 are also provided in the top and the bottom surfaces 32*c* and 32*d* parallel or substantially parallel to the concave portions 37, and dummy electrodes 39*a*, 39*b*, and 39*c* are provided therein. This type of electrode is formed such that, after a through-hole is formed in advance in a mother ferrite substrate, the through-hole is filled with a conductive conductor, and the substrate is then cut so as to divide the through-hole. In addition, the connection and interconnection electrodes may preferably be made of conductive films provided in the concave portions 37 and 38.

As the ferrite 32, YIG ferrite or other suitable ferrite may preferably be used, for example. The first and second central electrodes 35 and 36 and the other electrodes may preferably be formed of a thick film or a thin film of silver or a silver alloy, for example, by a printing, a transfer, or a photolithographic method. As the insulating film provided between the central electrodes 35 and 36, a dielectric thick film formed, for example, from glass or alumina or a resin film formed from polyimide may preferably be used, for example. These films described above may also preferably be formed, for example, by a printing, a transfer, or a photolithographic method.

In addition, the ferrite 32 may preferably be simultaneously fired together with the insulating film and the electrodes. In this case, the various electrodes are preferably made using Pd, Ag, or Pd/Ag, each of which can withstand high-temperature firing, for example.

As the permanent magnet 41, a strontium-based, a barium-based, or a lantern-cobalt-based ferrite magnet is preferably used, for example. As the adhesive 42 which adheres the permanent magnet 41 to the ferrite 32, a one-component type thermosetting epoxy adhesive is most preferably used, for example.

The substrate 20 is preferably made of the same type of material that is commonly used for a printed circuit board, for example, and the terminal electrodes 21*a* to 21*d* for soldering the connection electrodes 35*b*, 35*c*, and 36*p* of the ferrite-magnet element 30 and chip type matching circuit elements CS1 and R (see FIG. 5), input and output electrodes (not shown), and a ground electrode (not shown) are provided on the surface of the substrate 20. In addition, inside the substrate 20, matching circuit elements C1, C2, and CS2 (see FIG. 5) are preferably defined by internal electrodes.

The ferrite-magnet element 30 is disposed on the substrate 20, the connection electrodes 35*b*, 35*c*, and 36P provided on the bottom surface 32*d* of the ferrite 32 are integrally connected to the terminal electrodes 21*a*, 21*b*, and 21*c* on the substrate 20 by reflow soldering, and the bottom surfaces of the permanent magnets 41 are integrally adhered to the substrate 20 with an adhesive, for example. In addition, the matching elements CS1 and R are reflow-soldered to the terminal electrodes 21*b*, 21*c*, and 21*d*.

The flat plate yoke 10 functions as an electromagnetic shield and is adhered to the top surface of the ferrite-magnet element 30 with the second resin layer 60 provided therebetween, which will be described below.

Figure 5:
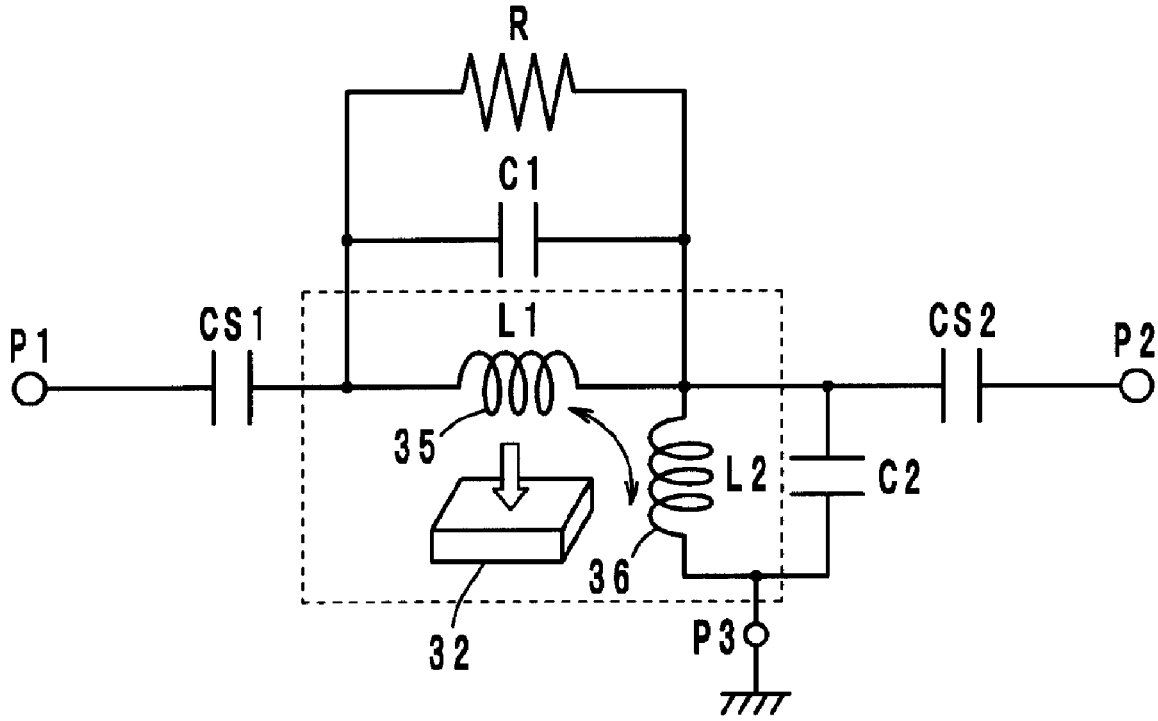
FIG. 5 is an equivalent circuit diagram showing one circuit example of a two-port isolator.

One circuit example of the isolator 1 is shown by an equivalent circuit in FIG. 5. An input port P1 is connected to the matching capacitor C1 and the terminal resistance R through the matching capacitor CS1, and the matching capacitor CS1 is connected to one end of the first central electrode 35. The other end of the first central electrode 35 and one end of the second central electrode 36 are connected to the terminal resistance R and the capacitors C1 and C2 and are further connected to an output port P2 through the capacitor CS2. The other end of the second central electrode 36 and the capacitor C2 are connected to a ground port P3.

In the two-port isolator 1 having the above-described equivalent circuit, one end of the first central electrode 35 is connected to the input port P1, the other end is connected to the output port P2, one end of the second central electrode 36 is connected to the output port P2, and the other end is connected to the ground port P3. Thus, a two-port lumped constant isolator having a low insertion loss is provided. In addition, during operation, a large high-frequency current flows through the second central electrode 36, and a high-frequency current does not significantly flow through the first central electrode 35.

In addition, since the ferrite 32 and a pair of the permanent magnets 41 are integrated with the adhesives 42 to define the ferrite-magnet element 30, the mechanical properties thereof are stabilized, and thus, a robust isolator that is not deformed or damaged by vibration and/or impact is obtained.

Figure 6:
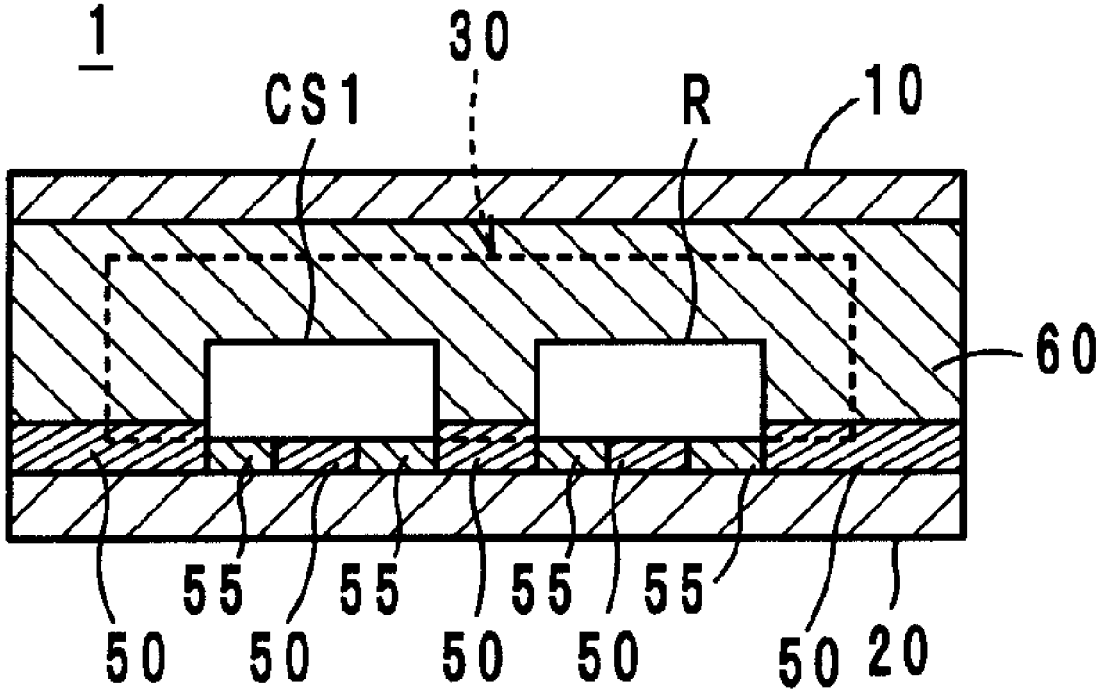
FIG. 6 is a cross-sectional view of the nonreciprocal circuit device taken along the line A-A shown in FIG. 1.

Next, the first and second resin layers 50 and 60 will be described. As shown in FIGS. 6 and 7B, the first resin layer 50 is a liquid thermosetting resin (such as a fine-grain epoxy resin) at room temperature disposed at bonding portions of the ferrite-magnet element 30 bonded to the substrate 20, and after being applied to the bonding portions, the liquid thermosetting resin is cured by heating. In FIGS. 6 and 7A to 7D, reference numeral 55 indicates bonding solder for the matching elements CS1 and R, and reference numeral 56 indicates bonding solder for the connection electrodes 35*b*, 35*c*, and 36*p* of the ferrite-magnet element 30.

Figure 7A:
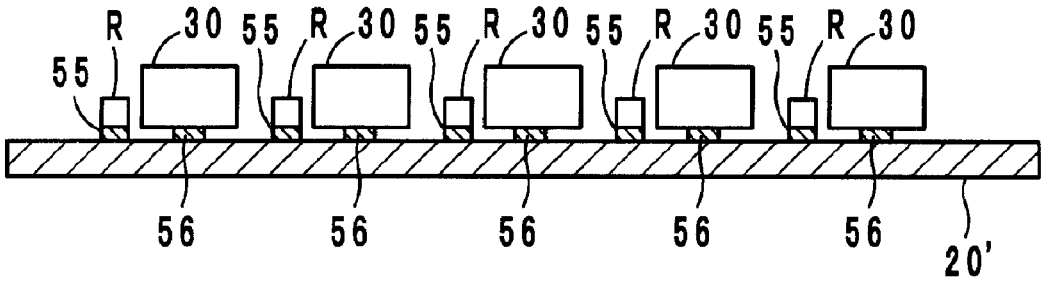
FIGS. 7A to 7D are cross-sectional views showing a manufacturing process for the nonreciprocal circuit device taken along the line B-B shown in FIG. 1.
Figure 7B:
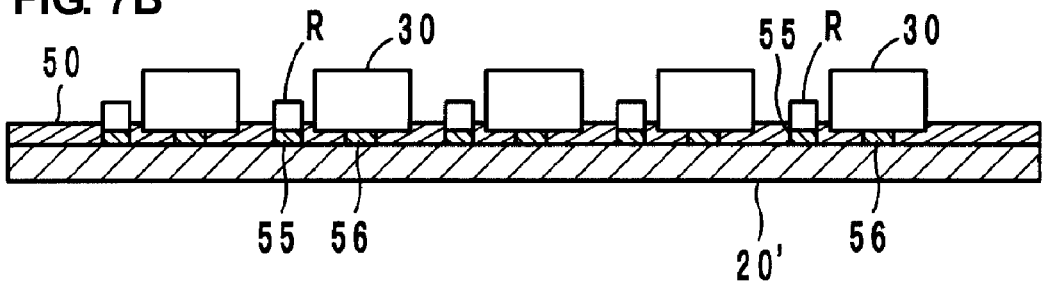
Figure 7C:
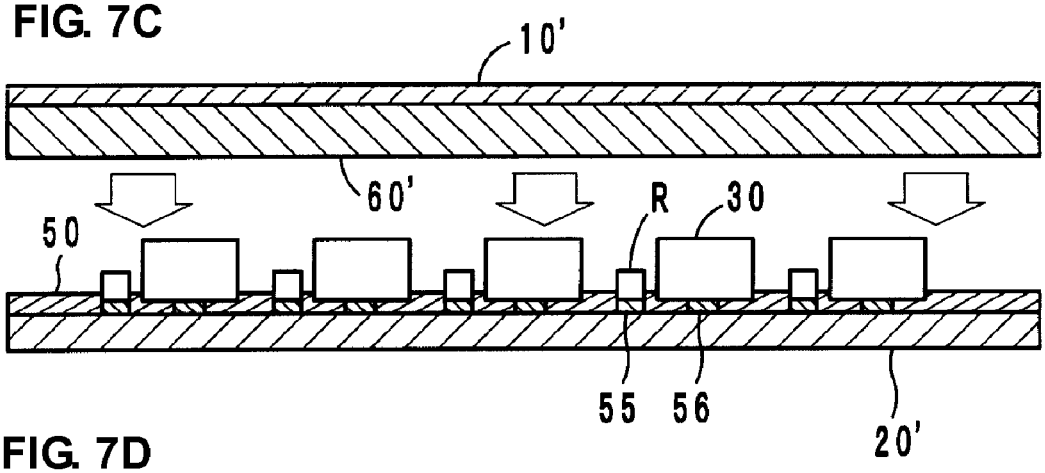

As shown in FIG. 7C, the second resin layer 60 is formed from a soft sheet-shaped thermosetting resin 60' (such as an epoxy resin) adhered to a rear surface of a mother yoke 10', which is a base material for the flat plate yokes 10, and is obtained such that the thermosetting resin 60' is disposed on the surface of the substrate 20 while pressure is applied, is then softened, and is finally cured.

Next, a manufacturing process for the isolator 1 according to the first preferred embodiment including the steps of forming the first and the second resin layers 50 and 60 will be described.

First, a plurality of the ferrite-magnet elements 30 is bonded to a surface of a mother substrate 20' in a matrix so that the primary surfaces 32*a* and 32*b* of each ferrite 32 are disposed perpendicular or substantially perpendicular to the surface of the mother substrate 20', and the matching elements CS1 and R are also bonded to the surface thereof (see FIG. 7A). Next, a liquid resin is applied to the bonding portions of the ferrite-magnet elements 30 and the matching elements CS1 and R which are bonded to the mother substrate 20' and is then cured, so that the first resin layer 50 is formed (see FIG. 7B). The liquid resin is a liquid at room temperature and is cured, for example, by heating at approximately 165° C. for approximately 90 minutes. The first resin layer 50 is filled in gaps formed on the surface of the substrate 20' between the solder bonding portions of the ferrite-magnet elements 30 and the matching circuit elements CS1 and R.

Next, as shown in FIG. 7C, after the mother yoke 10' provided with the soft sheet-shaped resin 60' which is adhered on the rear surface thereof is disposed on the upper surfaces of the ferrite-magnet elements 30, the soft sheet-shaped resin 60' is softened and is then cured, so that the second resin layer 60 is formed. The soft sheet-shaped resin 60' is softened and is then cured by heating at approximately 150° C. for approximately 180 minutes while pressure is applied. When being softened, the soft sheet-shaped resin 60' enters gaps formed between the ferrite-magnet elements 30 and the matching circuit elements CS1 and R and seals these elements from the outside (see FIG. 7D).

In particular, the step of forming the second resin layer 60 is performed such that an oven in which an inside pressure can be set at a high level is used, and the inside pressure of the oven is increased, for example, to approximately 4 to 5 atmospheric pressure.

Figure 7D:
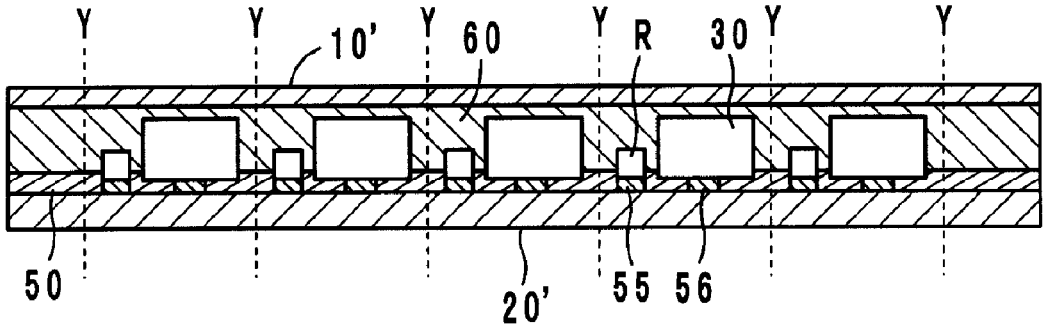

Subsequently, the mother substrate 20' and the mother yoke 10' are cut together along the dotted lines Y shown in FIG. 7D, and each unit obtained by cutting is used as the isolator 1. In this step, cutting is also performed for each unit in a direction perpendicular or substantially perpendicular to the dotted lines Y.

As described above, according to this first preferred embodiment, since the periphery of the ferrite-magnet element 30 is sealed with the first and the second resin layers 50 and 60, the influence of humidity is eliminated. Since the permanent magnets 41 are provided on the first and second primary surfaces 32*a* and 32*b* of the ferrite 32 which is provided with the central electrodes 35 and 36, a yoke surrounding the side portions of the ferrite 32 is not always necessary. In addition, the first and the second resin layers 50 and 60 can be easily formed, respectively, by automatically applying a liquid resin and by applying a pressure to the sheet shaped resin 60' adhered to the mother yoke 10', followed by softening. Furthermore, since the substrates 20 and the flat plate yokes 10 are formed from the mother substrate 20' and the mother yoke 10', respectively, manufacturing can be efficiently performed by a multiple-elements forming method.

In particular, according to the first preferred embodiment, since the first resin layer 50 is formed at the bonding portions so as to have a relatively small thickness, the volume of a relatively expensive liquid resin can be decreased, and the mother substrate 20' does not warp as the liquid resin is cured.

Second Preferred Embodiment

Figure 8:
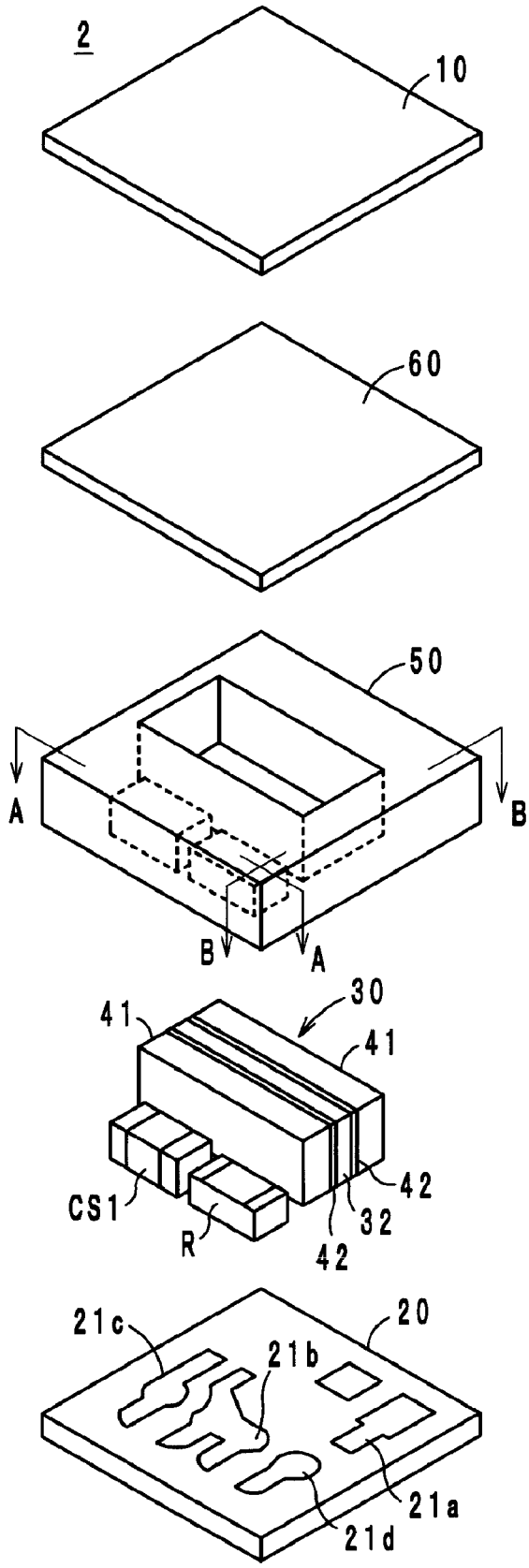
FIG. 8 is an exploded perspective view showing a nonreciprocal circuit device (e.g., two-port isolator) according to a second preferred embodiment of the present invention.

FIG. 8 is an exploded perspective view showing a two-port isolator 2 according to the second preferred embodiment of the nonreciprocal circuit device of the present invention. Since the two-port isolator 2 has substantially the same structure as that of the first preferred embodiment, the same elements and portion as those of the first preferred embodiment are designated by the same reference numerals, and a duplicated description will be omitted. The differences from the first preferred embodiment are that the first resin layer 50 has a relatively large thickness and the second resin layer 60 has a relatively small thickness.

Figure 9:
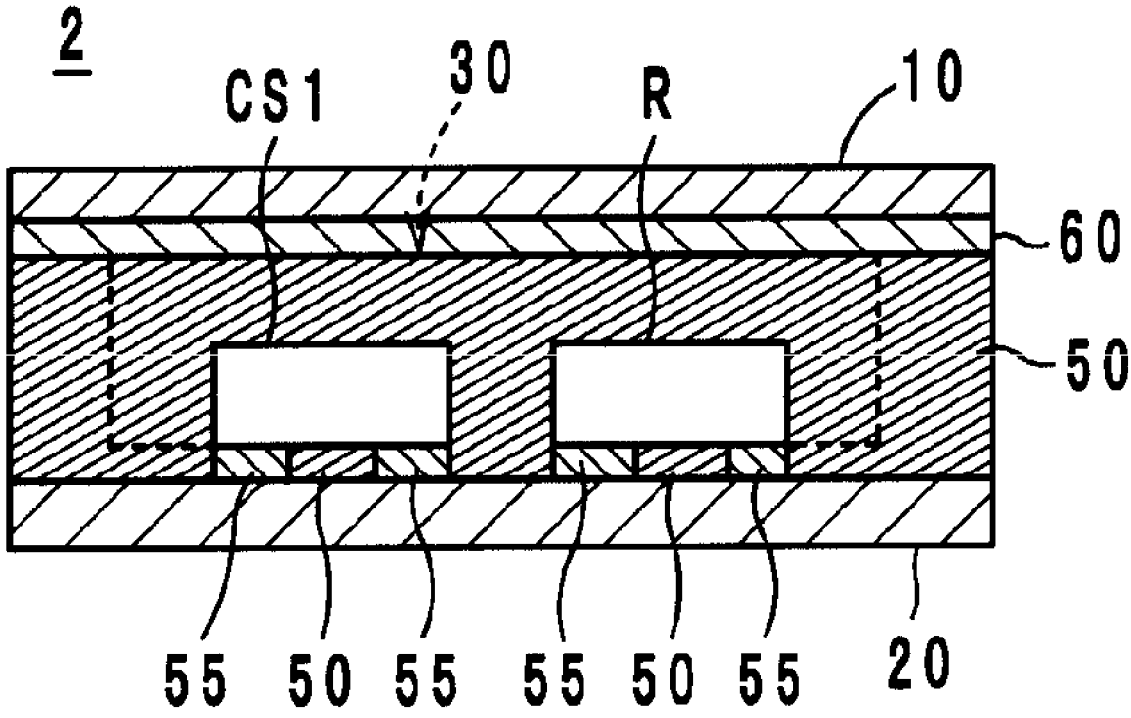
FIG. 9 is a cross-sectional view of the nonreciprocal circuit device taken along the line A-A shown in FIG. 8.

That is, as shown in FIG. 9, the first resin layer 50 extends from the surface of the substrate 20 to the upper surface of the ferrite-magnet element 30 including the bonding portions of the ferrite-magnet element 30 and the matching circuit elements CS1 and R which are bonded to the substrate 20. The second resin layer 60 extends between the flat plate yoke 10 and the upper surface of the ferrite-magnet element 30.

Figure 10A:
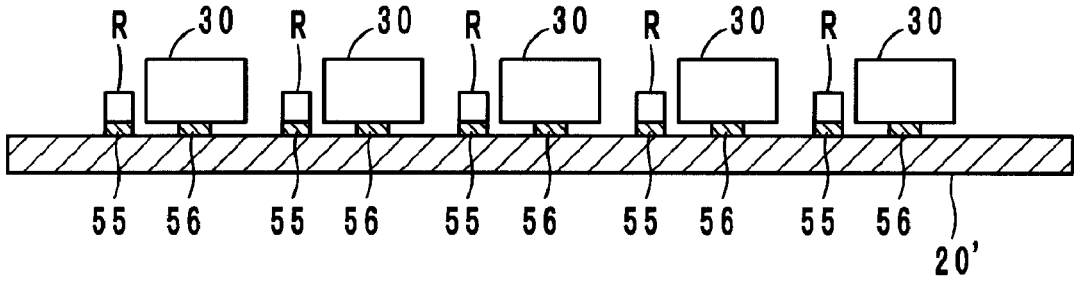
FIGS. 10A to 10D are cross-sectional views each showing a manufacturing process for the nonreciprocal circuit device taken along the line B-B shown in FIG. 8.
Figure 10B:
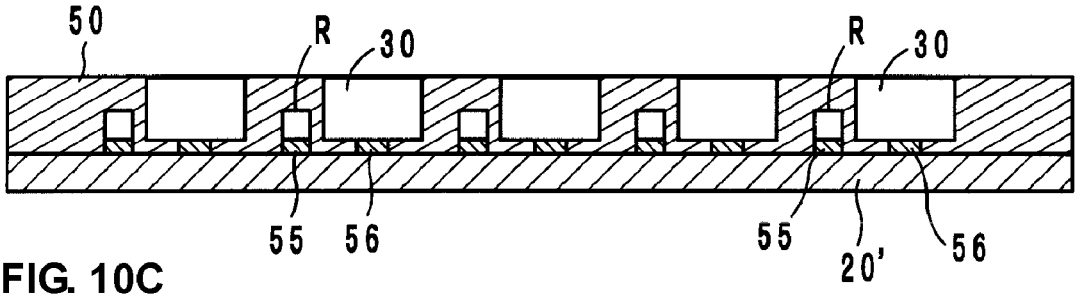

In a manufacturing process, first, a plurality of the ferrite-magnet elements 30 is bonded to the surface of the mother substrate 20' in a matrix so that the two primary surfaces 32*a* and 32*b* of the ferrite 32 are arranged perpendicular or substantially perpendicular to the surface of the mother substrate 20', and the matching circuit elements CS1 and R are also bonded to the surface thereof (see FIG. 10A). Next, a liquid resin is applied from the surface of the mother substrate 20' to the upper surfaces of the ferrite-magnet elements 30 and is then cured, so that the first resin layer 50 is formed (see FIG. 10B). The height of the ferrite-magnet element 30 is approximately 0.5 mm, and the liquid resin does not flow out of end portions of the mother substrate 20' and enters gaps between the ferrite-magnet elements 30. The heating temperature and the heating time for the liquid resin are approximately equivalent to those of the first preferred embodiment.

Figure 10C:
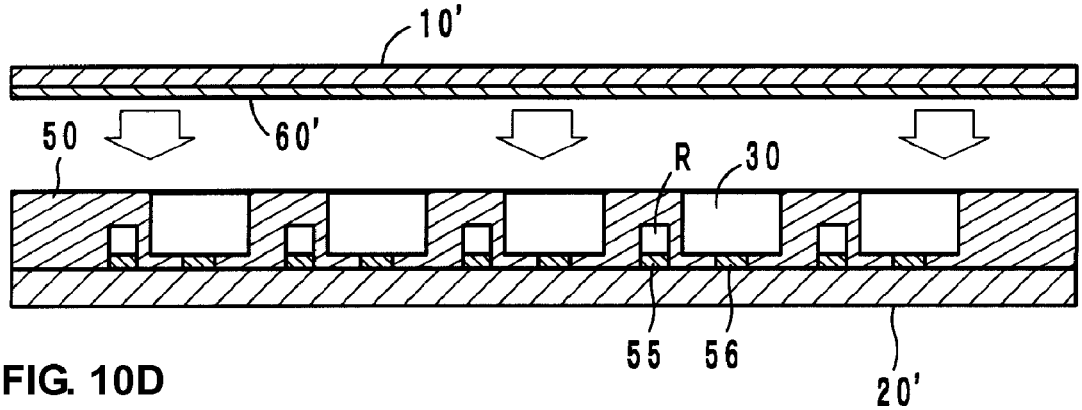

Subsequently, as shown in FIG. 10C, after the mother yoke 10' provided with the soft sheet-shaped resin 60' which is adhered to the rear surface thereof is disposed on the upper surfaces of the ferrite-magnet elements 30, the soft sheet-shaped resin 60' is softened and is then cured, so that the second resin layer 60 is formed (see FIG. 10D). In the step of forming the second resin layer 60, an oven in which an inside pressure can be set at a high level may also preferably be used in the second preferred embodiment. However, since the second resin layer 60 is provided between the flat plate yoke 10 and the upper surface of the ferrite-magnet element 30, the applied pressure, the heating temperature, and the heating time similar to those of the first preferred embodiment are not always necessary.

Figure 10D:
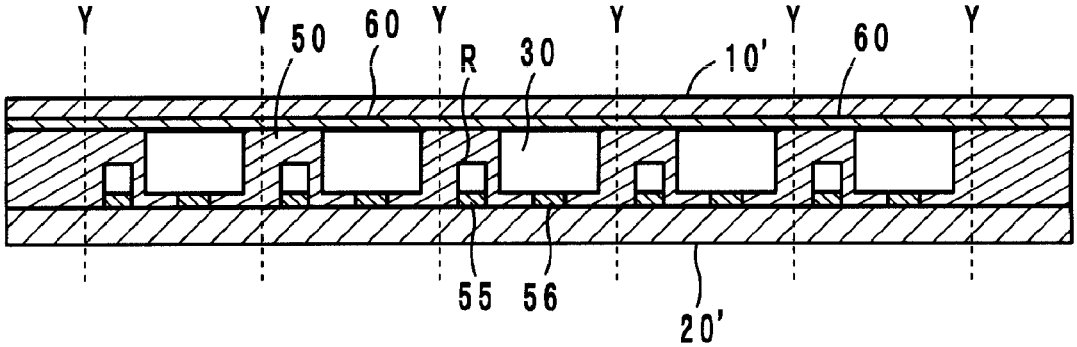

Next, the mother substrate 20' and the mother yoke 10' are cut together along the dotted lines Y shown in FIG. 10D, and each unit obtained by cutting is used as the isolator 2. In this step, cutting is also performed for each unit in a direction perpendicular or substantially perpendicular to the dotted lines Y.

The function and the benefits of the isolator 2 according to the second preferred embodiment substantially the same as those of the first preferred embodiment. In particular, since the periphery of the ferrite-magnet element 30 is covered with the liquid resin, gaps are not formed at the above periphery, and since the second resin layer 60 is formed on a flat upper surface of the ferrite-magnet element 30 and the first resin layer 50, the adhesion properties are greatly improved.

In addition, the nonreciprocal circuit device according to the present invention and the manufacturing method thereof are not limited to the preferred embodiments described above, and any changes and modifications may be made without departing from the spirit and the scope of the present invention.

In particular, the configuration of the matching circuit may be arbitrarily selected and all matching circuit elements may be provided on the substrate or may be embedded therein. In addition, in the ferrite-magnet element, the ferrite and the permanent magnets may be integrally fired.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A nonreciprocal circuit device comprising:

a ferrite-magnet element including a ferrite having two primary surfaces on which central electrodes are arranged to intersect each other in an electrically insulated manner and a pair of permanent magnets disposed on the two primary surfaces of the ferrite so as to apply a direct current magnetic field to the ferrite;

a substrate having a surface to which the ferrite-magnet element is bonded so that the two primary surfaces of the ferrite are perpendicular or substantially perpendicular to the surface of the substrate;

a flat plate yoke arranged to cover a top surface of the ferrite-magnet element;

a first resin layer arranged at least at a bonding portion of the ferrite-magnet element bonded to the substrate, the first resin layer including a cured liquid resin; and a second resin layer adhered to a rear surface of the flat plate yoke, the second resin layer including a cured soft sheet-shaped resin; wherein the ferrite-magnet element is completely sealed from outside by the first and second resin layers.

2. The nonreciprocal circuit device according to claim 1, wherein the first resin layer is arranged at the bonding portion; and the second resin layer is arranged at a periphery of the ferrite-magnet element.

3. The nonreciprocal circuit device according to claim 1, wherein the first resin layer is arranged at a periphery of the ferrite-magnet element including the bonding portion; and the second resin layer is arranged between the flat plate yoke and top surfaces of the first resin layer and the ferrite-magnet element.

4. The nonreciprocal circuit device according to claim 1, further comprising a matching circuit element disposed on the substrate and arranged adjacent to the ferrite-magnet element, the matching circuit element being covered with the first and the second resin layers.

* * * * *